US010136687B2

(12) United States Patent
Duffy

(10) Patent No.: US 10,136,687 B2
(45) Date of Patent: Nov. 27, 2018

(54) FILTERING FACE-PIECE RESPIRATOR HAVING NOSE NOTCH

(71) Applicant: 3M INNOVATIVE PROPERTIES COMPANY, St. Paul, MN (US)

(72) Inventor: Dean R. Duffy, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 353 days.

(21) Appl. No.: 15/181,928

(22) Filed: Jun. 14, 2016

(65) Prior Publication Data

US 2016/0287916 A1 Oct. 6, 2016

Related U.S. Application Data

(62) Division of application No. 14/013,382, filed on Aug. 29, 2013, now Pat. No. 9,603,396.

(51) Int. Cl.

| | |
|---|---|
| ***A62B 23/00*** | (2006.01) |
| ***A41D 13/11*** | (2006.01) |
| ***A62B 23/02*** | (2006.01) |
| ***A62B 18/08*** | (2006.01) |

(52) U.S. Cl.

CPC ..... *A41D 13/1115* (2013.01); *A41D 13/1161* (2013.01); *A62B 18/084* (2013.01); *A62B 23/025* (2013.01); *Y10T 29/49908* (2015.01)

(58) Field of Classification Search

CPC A41D 13/11; A41D 13/1123; A41D 13/1146; A41D 13/1115; A41D 13/1161; A62B 23/025; A62B 23/00; A62B 23/02; A62B 23/06; A62B 17/04; A62B 18/00; A62B 18/02; A62B 18/025; A62B 18/06; A61F 9/04; A61F 9/06

See application file for complete search history.

(56) References Cited

U.S. PATENT DOCUMENTS

| | | | | |
|---|---|---|---|---|
| 3,288,138 | A | 11/1966 | Sachs | |
| 4,037,593 | A | 7/1977 | Tate | |
| 4,167,185 | A | 9/1979 | Lewis | |
| 5,673,690 | A * | 10/1997 | Tayebi | A41D 13/1115 128/205.27 |
| 6,722,366 | B2 | 4/2004 | Bostock et al. | |
| 2001/0015205 | A1* | 8/2001 | Bostock | A41D 13/1115 128/206.19 |
| 2006/0266364 | A1 | 11/2006 | Turdijan | |
| 2008/0099022 | A1* | 5/2008 | Gebrewold | A62B 23/025 128/206.21 |
| 2011/0315144 | A1 | 12/2011 | Eitzman et al. | |
| 2012/0060843 | A1* | 3/2012 | Magidson | A41D 13/1115 128/206.19 |

(Continued)

FOREIGN PATENT DOCUMENTS

| | | |
|---|---|---|
| JP | 2009-011709 | 1/2009 |
| JP | 2012085728 | 5/2012 |

(Continued)

*Primary Examiner* — Tarla Patel

(57) ABSTRACT

A filtering face-piece respirator 10 that includes a harness 14 and a mask body 12 that has a multi-layer filtering structure 16. The mask body 12 includes an upper interior perimeter segment 24*a* formed from the filtering structure 16 and configured to fit against the face of the respirator wearer. Present in the upper interior perimeter segment 24*a* is a nose notch 52, 62, which is an area void of filtering structure 16.

4 Claims, 7 Drawing Sheets

(56) References Cited

U.S. PATENT DOCUMENTS

| | | | |
|---|---|---|---|
| 2015/0059771 | A1 | 3/2015 | Duffy |
| 2015/0059772 | A1 | 3/2015 | Duffy |
| 2015/0059773 | A1 | 3/2015 | Duffy |
| 2015/0059774 | A1 | 3/2015 | Duffy |

FOREIGN PATENT DOCUMENTS

| | | |
|---|---|---|
| RU | 28038 | 3/2003 |
| WO | WO 2009/146412 | 12/2009 |
| WO | WO 2010/143319 | 12/2010 |
| WO | WO 2012/089963 | 7/2012 |

* cited by examiner

FILTERING FACE-PIECE RESPIRATOR HAVING NOSE NOTCH

The present invention pertains to a filtering face-piece respirator that includes a notched region proximate the nose area of the respirator to facilitate sealing and improve comfort of the respirator.

BACKGROUND

Respirators are commonly worn over a person's breathing passages for at least one of two common purposes: (1) to prevent impurities or contaminants from entering the wearer's respiratory system; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to other persons or things, for example, in an operating room or clean room.

A variety of respirators have been designed to meet either (or both) of these purposes. Some respirators have been categorized as being "filtering face-pieces" because the mask body itself functions as the filtering mechanism. Unlike respirators that use rubber or elastomeric mask bodies in conjunction with attachable filter cartridges (see, e.g., U.S. Pat. RE39,493 to Yuschak et al.) or insert-molded filter elements (see, e.g., U.S. Pat. No. 4,790,306 to Braun), filtering face-piece respirators are designed to have the filter media cover much of the whole mask body so that there is no need for installing or replacing a filter cartridge. These filtering face-piece respirators commonly come in one of two configurations: molded respirators and flat-fold respirators.

Molded filtering face-piece respirators have regularly comprised non-woven webs of thermally-bonding fibers or open-work plastic meshes to furnish the mask body with its cup-shaped configuration. Molded respirators tend to maintain the same shape during both use and storage. These respirators therefore cannot be folded flat for storage and shipping. Examples of patents that disclose molded, filtering, face-piece respirators include U.S. Pat. No. 7,131,442 to Kronzer et al, U.S. Pat. Nos. 6,923,182, 6,041,782 to Angadjivand et al., U.S. Pat. No. 4,807,619 to Dyrud et al., and U.S. Pat. No. 4,536,440 to Berg.

Flat-fold respirators—as their name implies—can be folded flat for shipping and storage. They also can be opened into a cup-shaped configuration for use. Examples of flat-fold respirators are shown in U.S. Pat. Nos. 6,568,392 and 6,484,722 to Bostock et al., and U.S. Pat. No. 6,394,090 to Chen. Some flat-fold respirators have been designed with weld lines, seams, and folds, to help maintain their cup-shaped configuration during use. Stiffening members also have been incorporated into panels of the mask body (see U.S. Patent Application Publications 2001/0067700 to Duffy et al., 2010/0154805 to Duffy et al., and U.S. Design Pat. 659,821 to Spoo et al.).

The present invention, as described below, provides an improved fitting, comfortable flat-fold respirator.

SUMMARY OF THE INVENTION

The present invention provides a filtering face-piece respirator that comprises a mask body and an area void of perimeter material proximate the nose region of the mask body. The mask body comprises a filtering structure that contains one or more filter media layers sandwiched between an outer cover web and an inner cover web.

The nose notch improves the aesthetic look of the respirator, improves the comfort and fit of the respirator to the wearer's face, and also functionally improves the filtering face-piece respirator by reducing and preferably eliminating bunching of material in the nose region when the respirator is configured in a 'use', cup shape. The nose notch provides a receiving region that saddles or hugs the wearer's nose, improving the comfort and stability of the respirator when fitted on the wearer's face. The nose notch also improves sealing of the respirator to the face.

Glossary

The terms set forth below will have the meanings as defined:

"comprises" or "comprising" means its definition as is standard in patent terminology, being an open-ended term that is generally synonymous with "includes", "having", or "containing". Although "comprises", "includes", "having", and "containing" and variations thereof are commonly-used, open-ended terms, this invention also may be suitably described using narrower terms such as "consists essentially of", which is semi open-ended term in that it excludes only those things or elements that would have a deleterious effect on the performance of the inventive respirator in serving its intended function;

"clean air" means a volume of atmospheric ambient air that has been filtered to remove contaminants;

"contaminants" means particles (including dusts, mists, and fumes) and/or other substances that generally may not be considered to be particles (e.g., organic vapors, etc.) but which may be suspended in air;

"crosswise dimension" is the dimension that extends laterally across the respirator, from side-to-side when the respirator is viewed from the front;

"cup-shaped configuration" and variations thereof, means any vessel-type shape that is capable of adequately covering the nose and mouth of a person;

"exterior gas space" means the ambient atmospheric gas space into which exhaled gas enters after passing through and beyond the mask body and/or exhalation valve;

"filtering face-piece" means that the mask body itself is designed to filter air that passes through it; there are no separately identifiable filter cartridges or insert-molded filter elements attached to or molded into the mask body to achieve this purpose;

"filter" or "filtration layer" means one or more layers of air-permeable material, which layer(s) is adapted for the primary purpose of removing contaminants (such as particles) from an air stream that passes through it;

"filter media" means an air-permeable structure that is designed to remove contaminants from air that passes through it;

"filtering structure" means a generally air-permeable construction that filters air;

"folded inwardly" means being bent back towards the part from which extends;

"harness" means a structure or combination of parts that assists in supporting the mask body on a wearer's face;

"interior gas space" means the space between a mask body and a person's face;

"line of demarcation" means a fold, seam, weld line, bond line, stitch line, hinge line, and/or any combination thereof;

"mask body" means an air-permeable structure that is designed to fit over the nose and mouth of a person and that helps define an interior gas space separated from an exterior gas space (including the seams and bonds that join layers and parts thereof together);

"nose clip" means a mechanical device (other than a nose foam), which device is adapted for use on a mask body to improve the seal at least around a wearer's nose;

"perimeter" means the outer edge of the mask body, which outer edge would be disposed generally proximate to a wearer's face when the respirator is being donned by a person; a "perimeter segment" is a portion of the perimeter;

"pleat" means a portion that is designed to be or is folded back upon itself;

"polymeric" and "plastic" each mean a material that mainly includes one or more polymers and that may contain other ingredients as well;

"respirator" means an air filtration device that is worn by a person to provide the wearer with clean air to breathe; and "transversely extending" means extending generally in the crosswise dimension.

DETAILED DESCRIPTION OF PREFERRED EMBODIMENTS

Figure 1:
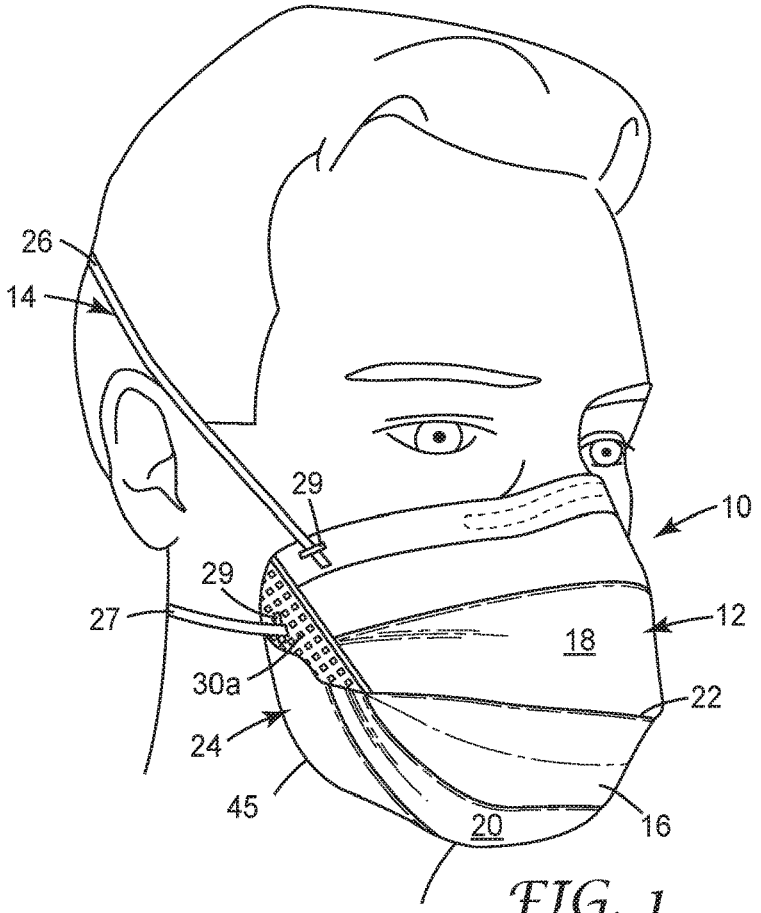
FIG. 1 is a front perspective view of a flat-fold filtering face-piece respirator 10 being worn on a person's face.

In practicing the present invention, a filtering face-piece respirator is provided that has a notched region, or a void, at the region of the respirator proximate the nose, when the mask is being worm on the face of a wearer. The notched region enhances the comfort and sealing of the respirator to the face of the wearer.

In the following description, reference is made to the accompanying drawings that form a part hereof and in which are shown by way of illustration various specific embodiments. The various elements and reference numerals of one embodiment described herein are consistent with and the same as the similar elements and reference numerals of another embodiment described herein, unless indicated otherwise. It is to be understood that other embodiments are contemplated and may be made without departing from the scope or spirit of the present invention. The following description, therefore, is not to be taken in a limiting sense. While the present invention is not so limited, an appreciation of various aspects of the invention will be gained through a discussion of the examples provided below.

Figure 2:
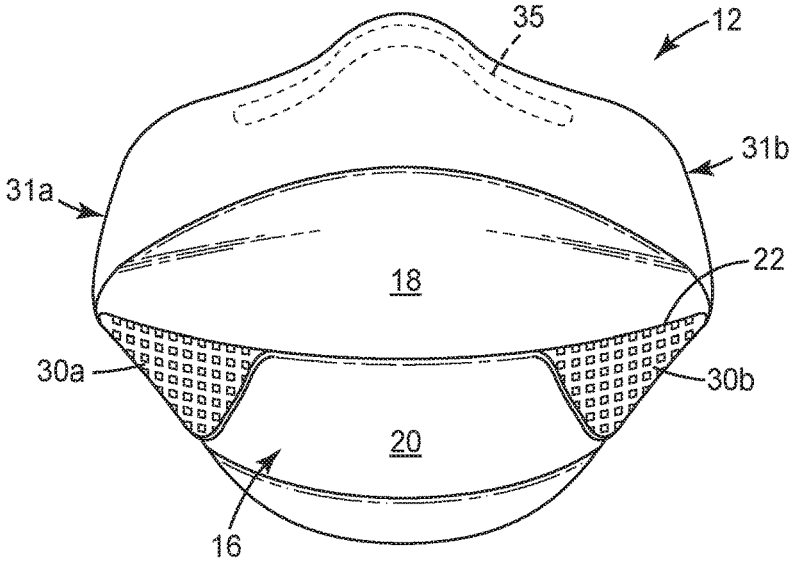
FIG. 2 is a front view of a mask body 12 of respirator 10 of FIG. 1.

Turning to the figures, FIG. 1 shows an example of a filtering face-piece respirator 10 that may be used in connection with the present invention to provide clean air for the wearer to breathe. The filtering face-piece respirator 10 includes a mask body 12 and a harness 14. For simplicity, FIG. 2 shows the mask body 12 without the harness 14. The mask body 12 has a filtering structure 16 through which inhaled air must pass before entering the wearer's respiratory system. The filtering structure 16 removes contaminants from the ambient environment so that the wearer breathes clean air. The filtering structure 16 may take on a variety of different shapes and configurations and typically is adapted so that it properly fits against the wearer's face or within a support structure. Generally the shape and configuration of the filtering structure 16 corresponds to the general shape of the mask body 12.

The mask body 12 includes a top portion 18 and a bottom portion 20 separated by a line of demarcation 22. In this particular embodiment, the line of demarcation 22 is a fold or pleat that extends transversely across the central portion of the mask body from side-to-side. The mask body 12 also includes a perimeter fold 45 extending around at least a portion of the mask body 12. The portion of the filtering structure 16 that is folded over and that is proximate the wearer's face when respirator 10 is positioned on a wearer's face includes an upper interior perimeter segment 24*a* (FIG. 5) at top portion 18 and a lower interior perimeter segment 24*b* (FIG. 6) at bottom portion 20. Upper interior perimeters segment 24*a* and lower interior perimeter segment 24*b*, and optionally fold 45, form a seal between the mask body 12 and the wearer's face.

The harness 14 (FIG. 1) has a first, upper strap 26 that is secured to the top portion 18 of mask body 12 by a staple 29 and a second, lower strap 27. The straps 26, 27 may be made from a variety of materials, such as thermoset rubbers, thermoplastic elastomers, braided or knitted yarn and/or rubber combinations, inelastic braided components, and the like. The straps 26, 27 preferably can be expanded to greater than twice their total length and be returned to their relaxed state. The straps 26, 27 also could possibly be increased to three or four times their relaxed state length and can be returned to their original condition without any damage thereto when the tensile forces are removed. The straps 26, 27 may be continuous straps or may have a plurality of parts, which can be joined together by further fasteners or buckles. Alternatively, the straps may form a loop that is placed around the wearer's ears.

FIG. 2 shows the mask body 12 with first and second flanges 30*a* and 30*b* located on opposing sides 31*a*, 31*b* of the mask body 12. Straps 26, 27 (FIG. 1) extend from side 31*a* to side 31*b*. An end of the second strap 27 is stapled to each flange 30*a*, 30*b* by a staple 29.

The flanges 30*a* and 30*b* are folded inwardly towards the filtering structure 16 in contact therewith. Additional details regarding flanges 30*a* and 30*b* and other features of respirator 10 and mask body 12 can be found in U.S. patent application Ser. No. 13/727,923 filed Dec. 27, 2012, titled "Filtering Face-Piece Respirator Having Folded Flange," the entire disclosure of which is incorporated herein by reference.

A nose clip 35 (FIG. 2) is disposed on the top portion 18 of the mask body adjacent to the interior perimeter segment 24*a*, centrally positioned between the mask body side edges, to assist in achieving an appropriate fit on and around the nose and upper cheek bones. The nose clip 35 may be made from a pliable metal or plastic that is capable of being manually adapted by the wearer to fit the contour of the wearer's nose. The nose clip 35 may comprise, for example, a malleable or pliable soft band of metal such as aluminum, which can be shaped to hold the mask in a desired fitting relationship over the nose of the wearer and where the nose meets the cheek.

Figure 3A:
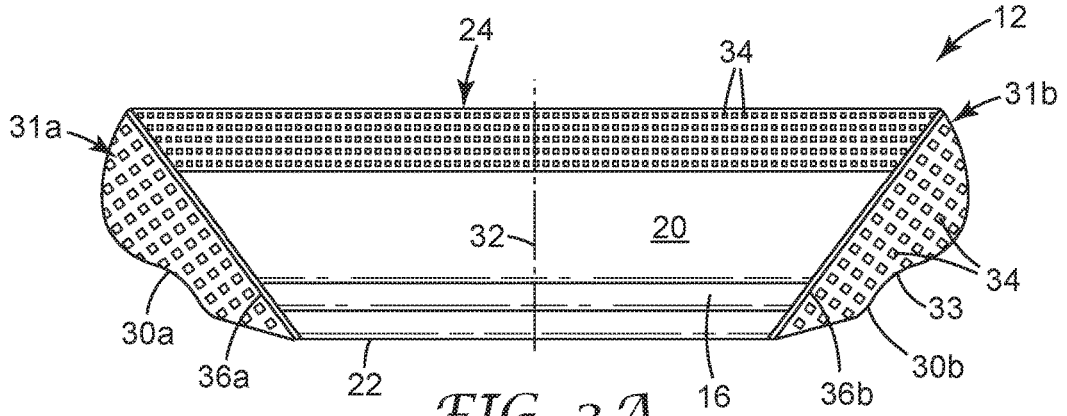
FIG. 3*a* is a bottom view of the mask body 12 in a pre-opened or flat configuration with the flanges 30*a*, 30*b* in an unfolded position.
Figure 3B:
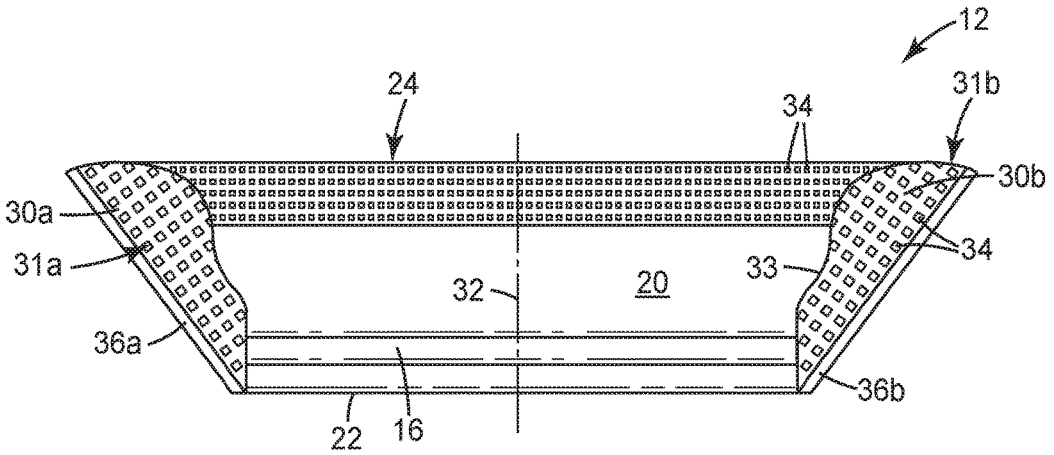
FIG. 3*b* is a bottom view of the mask body 12 in a pre-opened or flat configuration with the flanges 30*a*, 30*b* folded against the filtering structure 16.

FIGS. 3*a* and 3*b* show the mask body 12 in a flat, folded or collapsed configuration; this configuration may also be referred to as a pre-opened configuration. Additional features and details of respirator 10 and mask body 12 can be seen in this configuration.

A plane 32 bisects the mask body 12 to define the first and second sides 31*a*, 31*b*. The first and second flanges 30*a* and 30*b* located on opposing sides 31*a* and 31*b*, respectively, of the mask body 12 can be readily seen, particularly in FIG. 3*a*. The flanges 30*a*, 30*b* typically extend away from the mask body 12 and may be integrally or non-integrally connected to the major portion of the mask body 12. Although the flanges 30*a*, 30*b* may comprise one or more or all of the various layers that comprise the mask body filtering structure 16, the flanges 30*a*, 30*b* are not part of the primary filtering area of the mask body 12. Unlike the filtering structure 16, the layers that comprise the flanges 30*a*, 30*b* may be compressed, rendering them nearly fluid impermeable. The flanges 30*a*, 30*b* may be an extension of the material used to make the mask body filtering structure 16, or they may be made from a separate material such as a rigid or semi-rigid plastic. The flanges 30*a*, 30*b* can have welds or bonds 34 thereon to increase flange stiffness, and the mask body interior perimeter segment 24*b* also may have a series of bonds or welds 34 to join the various layers of the mask body 12 together. This interior perimeter segment 24*b* therefore may not be very fluid permeable. Interior perimeter segment 24*a* (FIGS. 5 and 6) also may have a series of bonds or welds to join the various layers together and also to maintain the position of a nose clip 35. The remainder of the filtering structure 16—inwardly from the perimeter—may be fully fluid (e.g., air) permeable over much of its extended surface, with the possible exception of areas where there are bonds, welds, or fold lines.

The mask body 12 also includes first and second lines of demarcation 36*a*, 36*b* located on first and second sides of the mask body 12. The first and second flanges 30*a*, 30*b* are joined to the mask body 12 at the first and second lines of demarcation 36*a*, 36*b* and may be rotated or folded one these demarcation lines 36*a*, 36*b*, about an axis or fold line generally parallel to or close to parallel to, or at an angle of no more than about 30 degrees to these demarcation lines 36*a*, 36*b* to form the configuration of FIG. 3*b*. The bottom portion 20 may include one or more pleat lines that extend from the first line of demarcation 36*a* to the second line of demarcation 36*b* transversely.

The filtering structure 16 that is used in the mask body 12 can be of a particle capture or gas and vapor type filter. The filtering structure 16 also may be a barrier layer that prevents the transfer of liquid from one side of the filter layer to another to prevent, for instance, liquid aerosols or liquid splashes (e.g., blood) from penetrating the filter layer. Multiple layers of similar or dissimilar filter media may be used to construct the filtering structure 16 as the application requires. Filtration layers that may be beneficially employed in a layered mask body are generally low in pressure drop (for example, less than about 195 to 295 Pascals at a face velocity of 13.8 centimeters per second) to minimize the breathing work of the mask wearer. Filtration layers additionally may be flexible and may have sufficient shear strength so that they generally retain their structure under the expected use conditions.

Figure 4:
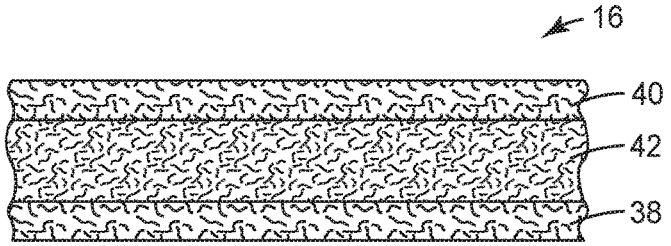
FIG. 4 is a cross-sectional view of a filtering structure 16 suitable for use in the mask body 12 of FIG. 2.

FIG. 4 shows an exemplary filtering structure 16 having multiple layers such as an inner cover web 38, an outer cover web 40, and a filtration layer 42. The filtering structure 16 also may have a structural netting or mesh juxtaposed against at least one or more of the layers 38, 40, or 42, typically against the outer surface of the outer cover web 40, that assist in providing a cup-shaped configuration. The filtering structure 16 also could have one or more horizontal and/or vertical lines of demarcation (e.g., pleat, fold, or rib) that contribute to its structural integrity.

An inner cover web 38 can be used to provide a smooth surface for contacting the wearer's face, and an outer cover web 40 can be used to entrap loose fibers in the mask body or for aesthetic reasons. Both cover webs 38, 40 protect the filtration layer 42. The cover webs 38, 40 typically do not provide any substantial filtering benefits to the filtering structure 16, although outer cover web 40 can act as a pre-filter to the filtration layer 42. To obtain a suitable degree of comfort, the inner cover web 38 preferably has a comparatively low basis weight and is formed from comparatively fine fibers, often finer than those of outer cover web 40. Either or both cover webs 38, 40 may be fashioned to have a basis weight of about 5 to about 70 g/m$^2$ (typically about 17 to 51 g/m$^2$ and in some embodiments 34 to 51 g/m$^2$), and the fibers may be less than 3.5 denier (typically less than 2 denier, and more typically less than 1 denier) but greater than 0.1. Fibers used in the cover webs 38, 40 often have an average fiber diameter of about 5 to 24 micrometers, typically of about 7 to 18 micrometers, and more typically of about 8 to 12 micrometers. The cover web material may have a degree of elasticity (typically, but not necessarily, 100 to 200% at break) and may be plastically deformable.

Typically, the cover webs 38, 40 are made from a selection of nonwoven materials that provide a comfortable feel, particularly on the side of the filtering structure that makes contact with the wearer's face, i.e., inner cover web 38. Suitable materials for the cover web may be blown microfiber (BMF) materials, particularly polyolefin BMF materials, for example polypropylene BMF materials (including polypropylene blends and also blends of polypropylene and polyethylene). Spun-bond fibers also may be used.

A typical cover web may be made from polypropylene or a polypropylene/polyolefin blend that contains 50 weight percent or more polypropylene. Polyolefin materials that are suitable for use in a cover web may include, for example, a single polypropylene, blends of two polypropylenes, and blends of polypropylene and polyethylene, blends of polypropylene and poly(4-methyl-1-pentene), and/or blends of polypropylene and polybutylene. Cover webs 38, 40 preferably have very few fibers protruding from the web surface after processing and therefore have a smooth outer surface.

The filtration layer 42 is typically chosen to achieve a desired filtering effect. The filtration layer 42 generally will remove a high percentage of particles and/or other contaminants from the gaseous stream that passes through it. For fibrous filter layers, the fibers selected depend upon the kind of substance to be filtered.

The filtration layer 42 may come in a variety of shapes and forms and typically has a thickness of about 0.2 millimeters (mm) to 5 mm, more typically about 0.3 mm to 3 mm (e.g., about 0.5 mm), and it could be a generally planar web or it could be corrugated to provide an expanded surface area. The filtration layer also may include multiple filtration layers joined together by an adhesive or any other means. Essentially any suitable material that is known (or later developed) for forming a filtering layer may be used as the filtering material. Webs of melt-blown fibers, especially when in a persistent electrically charged (electret) form are especially useful. Electrically charged fibrillated-film fibers also may be suitable, as well as rosin-wool fibrous webs and webs of glass fibers or solution-blown, or electrostatically sprayed fibers, especially in microfilm form. Also, additives can be included in the fibers to enhance the filtration performance of webs produced through a hydro-charging process. Fluorine atoms, in particular, can be disposed at the surface of the fibers in the filter layer to improve filtration performance in an oily mist environment.

Examples of particle capture filters include one or more webs of fine inorganic fibers (such as fiberglass) or polymeric synthetic fibers. Synthetic fiber webs may include electret-charged, polymeric microfibers that are produced from processes such as meltblowing. Polyolefin microfibers formed from polypropylene that has been electrically-charged provide particular utility for particulate capture applications. An alternate filter layer may comprise a sorbent component for removing hazardous or odorous gases from the breathing air. Sorbents may include powders or granules that are bound in a filter layer by adhesives, binders, or fibrous structures. A sorbent layer can be formed by coating a substrate, such as fibrous or reticulated foam, to form a thin coherent layer. Sorbent materials may include activated carbons that are chemically treated or not, porous alumina-silica catalyst substrates, and alumina particles.

Although the filtering structure 16 has been illustrated in FIG. 4 with one filtration layer 42 and two cover webs 38, 40, the filtering structure 16 may comprise a plurality or a combination of filtration layers 42. For example, a pre-filter may be disposed upstream to a more refined and selective downstream filtration layer. Additionally, sorptive materials such as activated carbon may be disposed between the fibers and/or various layers that comprise the filtering structure. Further, separate particulate filtration layers may be used in conjunction with sorptive layers to provide filtration for both particulates and vapors.

During respirator use, incoming air passes sequentially through layers 40, 42, and 38 before entering the mask interior. The air that is within the interior gas space of the mask body may then be inhaled by the wearer. When a wearer exhales, the air passes in the opposite direction sequentially through layers 38, 42, and 40. Alternatively, an exhalation valve (not shown) may be provided on the mask body 12 to allow exhaled air to be rapidly purged from the interior gas space to enter the exterior gas space without passing through filtering structure 16. The use of an exhalation valve may improve wearer comfort by rapidly removing the warm moist exhaled air from the mask interior. Essentially any exhalation valve that provides a suitable pressure drop and that can be properly secured to the mask body may be used in connection with the present invention to rapidly deliver exhaled air from the interior gas space to the exterior gas space.

Figure 5:
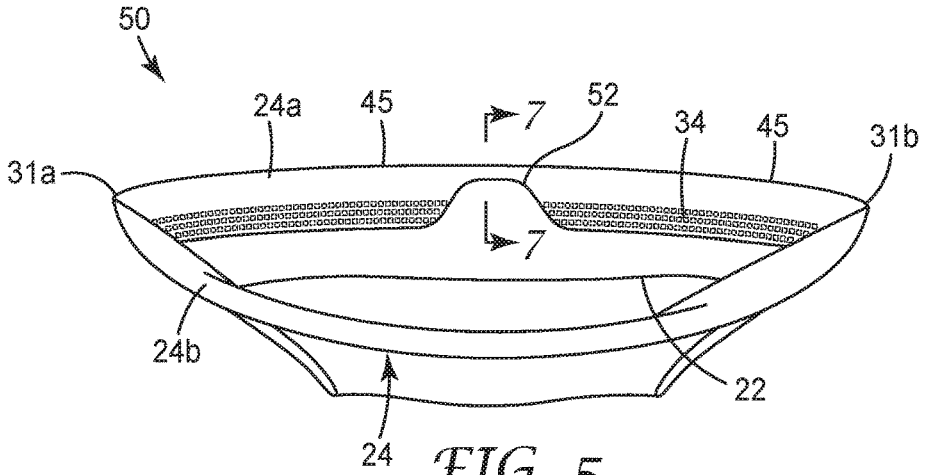
FIG. 5 is a bottom view of a mask body 50 having a first embodiment of a nose notch 52, the mask body in a partially opened configuration.
Figure 6:
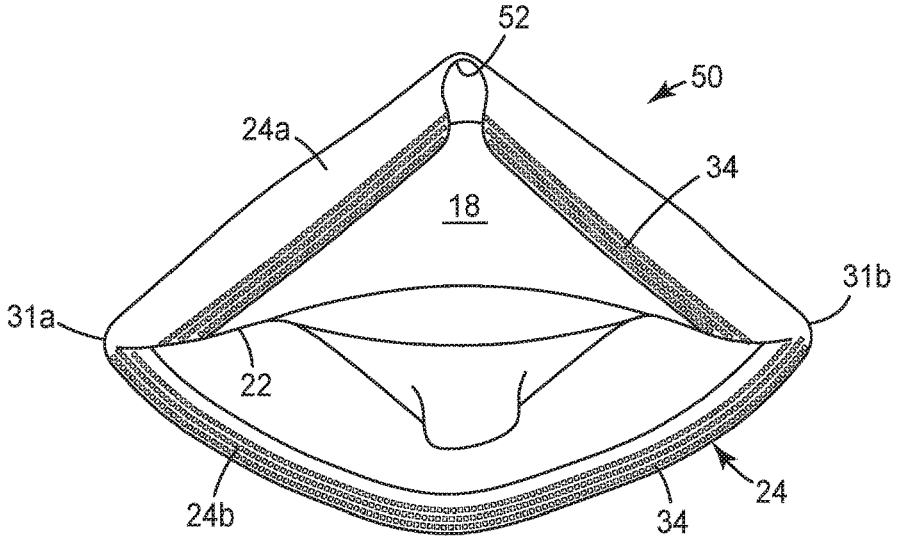
FIG. 6 is a back view of the mask body 50 of FIG. 5 in an opened configuration.
Figure 7:
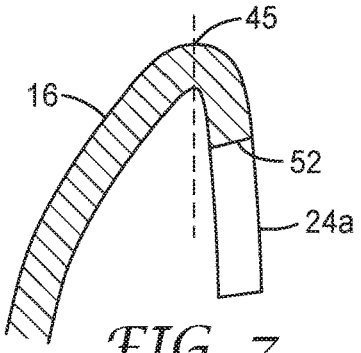
FIG. 7 is a cross-sectional view of the upper interior perimeter segment 24*a* and the nose notch 52 taken along lines 7-7 of FIG. 5.

In accordance with the present invention, the filtering face-piece respirator 10 includes an area of removed perimeter material, in a region proximate the nose area, when the respirator 10 is affixed to the wearer's face. FIGS. 5, 6 and 7 illustrate a mask body of the respirator with a first embodiment of a "nose notch" and FIGS. 8, 9 and 10 illustrate a mask body of the respirator with a second embodiment of a "nose notch." The nose notch of FIGS. 5, 6, and 7 can be referred to as a "shallow" nose notch, the notch present in only the interior perimeter segment 24*a*, whereas the nose notch of FIGS. 8, 9 and 10 can be referred to as a "deep" nose notch, the notch present in both the interior perimeter segment 24*a* and in the filtering structure 16 across the fold 45.

Mask body 50 of FIGS. 5 and 6, similar to mask body 12 of FIGS. 2 and 3, has a top portion 18 and a bottom portion 20 separated by a line of demarcation 22 such as a fold or pleat that extends transversely across the central portion of the mask body from side 31*a* to side 31*b*. The mask body 50 also includes a perimeter 24 that includes an upper interior perimeter segment 24*a* at top portion 18 and a lower interior perimeter segment 24*b* at bottom portion 20. Both upper interior perimeter segment 24*a* and lower interior perimeter segment 24*b* may have a series of bonds or welds 34 to join the various layers of the filtering structure 16 together. Present in upper interior perimeter segment 24*a* is a nose notch 52, which is a void in the various layers of the filtering structure 16. That is, nose notch 52 is formed by removing a piece of the filtering structure 16 that forms upper interior perimeter segment 24*a*.

As indicated above, nose notch 52 is a shallow nose notch, present in only perimeter upper segment 24*a*. As seen in FIG. 7, upper interior perimeter segment 24*a* is proximate the useable portion of the filtering structure 16 by a fold 45. Nose notch 52 is present only in upper interior perimeter segment 24*a* and does not extend to or through fold 45 to filtering structure 16.

Figure 8:
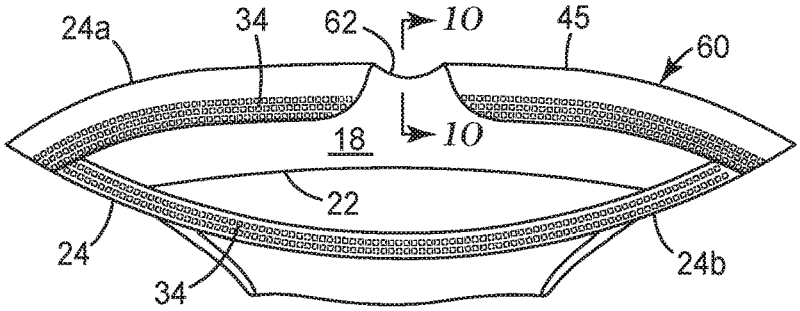
FIG. 8 is a bottom view of a mask body 60 having a second embodiment of a nose notch 62, the respirator in a partially opened configuration.
Figure 9:
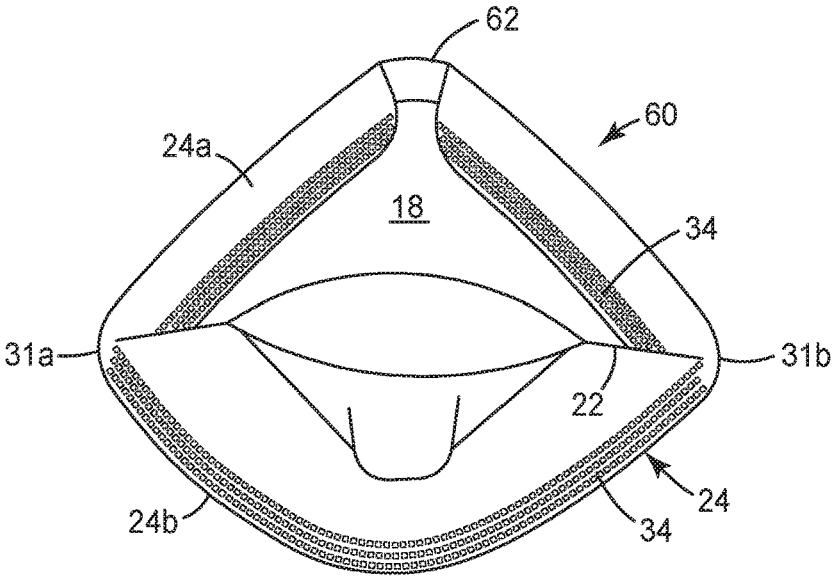
FIG. 9 is a back view of the mask body 60 of FIG. 8 in an opened configuration.
Figure 10:
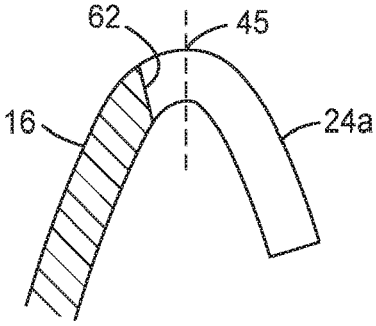
FIG. 10 is a cross-sectional view of the upper interior perimeter segment 24*a* and the nose notch 62 taken along lines 10-10 of FIG. 8.

Turning to FIGS. 8 and 9, mask body 60, similar to mask body 50 of FIGS. 5 and 6, has a top portion 18 and a bottom portion 20 separated by a line of demarcation 22 such as a fold or pleat that extends transversely across the central portion of the mask body from side 31*a* to side 31*b*. The mask body 60 also includes a perimeter 24 that includes an upper interior perimeter segment 24*a* at top portion 18 and a lower interior perimeter segment 24*b* at bottom portion 20. Both interior perimeter segments 24*a*, 24*b* have a series of bonds or welds 34 to join the various layers of the mask body 60 together. Present in the upper interior perimeter segment 24*a* is a nose notch 62, which is a void in the various layers of the filtering structure 16. That is, nose notch 62 is formed by removing a piece of the filtering structure 16 that forms the upper interior perimeter segment 24*a*. Unlike nose notch 52 of FIGS. 5, 6 and 7, nose notch 62 is a deep nose notch, present in upper perimeter segment 24*a*, through fold 45 and into filtering structure 16 (see FIG. 10).

The nose notches 52, 62, being a void in the upper interior perimeter segment 24*a*, improve the aesthetic and also functional features of the mask body 50, 60 by reducing and preferably eliminating bunching of the interior perimeter segment 24*a* when the mask body 50, 60 is configured in the 'use', cup shape, as in FIGS. 6 and 9. The nose notches 52, 62 provide a receiving region that saddles or hugs the wearer's nose, improving the comfort and stability of the respirator when fitted on the wearer's face and also improves sealing of the respirator to the face.

Various sizes (widths, depths) and shapes can be used for the nose notches 52, 62 for different purposes. For example, a small width nose notch enhances the stability of the face mask on the wearer's face by cradling the nose region. In some embodiments, it may be desired to include a nose cushioning member, such as an open cell foam, proximate the nose notch 52, 62 and the nose clip 35 (FIG. 2) to further increase the wearer's comfort.

Nose notch 52, 62 may have a maximum width, measured along the upper interior perimeter segment 24*a*, of no more than 50 mm, in most embodiments no more than 40 mm. The maximum width of nose notch 52, 62 may be, for example, 30 mm to 40 mm, or 10 mm to 25 mm. In most embodiments, the maximum width will be at the edge of the interior perimeter segment 24*a*, farthest from the fold 45. In some embodiments, the width of nose notch 52, 62 is constant or essentially constant along the depth of the nose notch 52, 62, whereas in other embodiments the width will taper along its depth. There is no minimum width allotted for the nose notch 52, 62; in fact, in some embodiments, a mere slit may be sufficient. In most embodiment, however, the width of nose notch 52, 62 is at least 3 mm.

Nose notch 52, 62 may have a depth, measured from the edge of the interior perimeter segment 24*a* (farthest from the fold 45), of at least 5 mm, and no more than 30 mm or 3 cm. The depth of nose notch 52 may be, for example, 10 mm to 25 mm, or 12 mm to 20 mm. For embodiments where the nose notch is a deep nose notch, such as nose notch 62, that extends to and optionally through the fold 45, the nose notch 62 extends no more than 10 mm past the fold 45, in some embodiments no more than 5 mm.

Figure 11A:
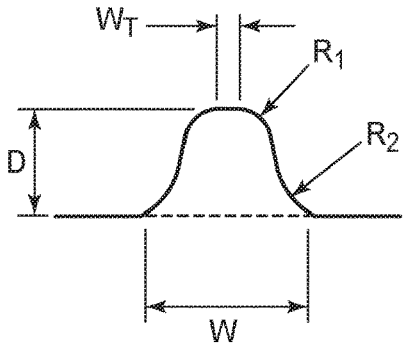
FIGS. 11A-11G are geometric renderings of possible nose notches.
Figure 11B:
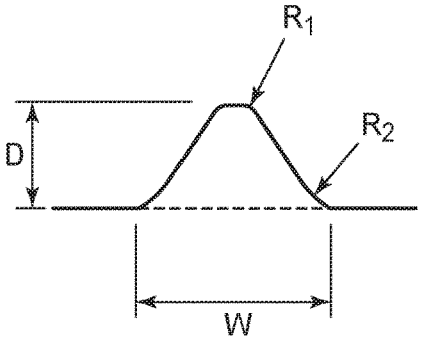
Figure 11C:
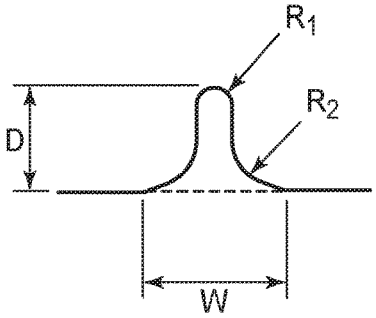
Figure 11D:
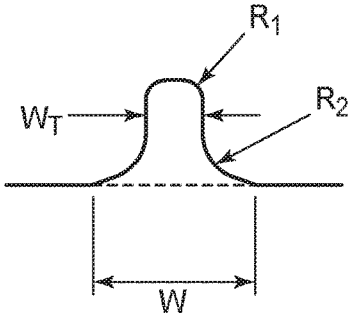
Figure 11E:
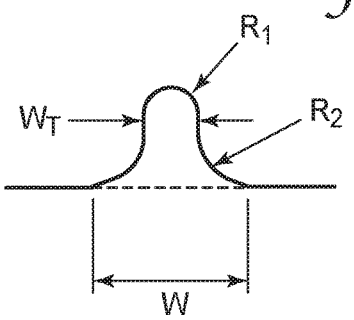
Figure 11F:
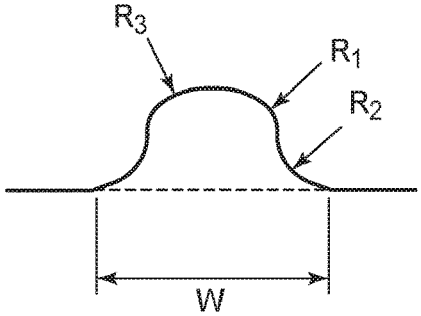
Figure 11G:
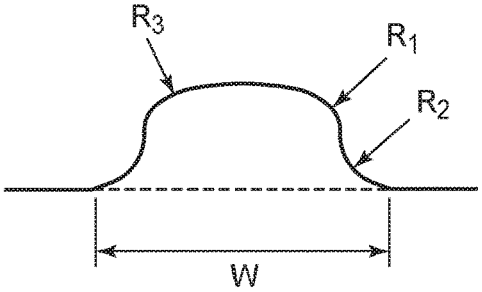

FIGS. 11A through 11G show seven variations of nose notches. Any of these notches may be 'shallow' or 'deep,' depending on the distance from the edge of upper interior perimeter segment 24*a* to fold 45. In FIG. 11A, the nose notch has a depth D of 13.2 mm, a width W of 20 mm, a tip width $W_T$ at its terminal end of 2.31 mm, a first radius $R_1$ for the terminal end of 4 mm and a second radius $R_2$ of 10.5 mm. In FIG. 11B, the notch has a depth D of 13.2 mm, a width W of 24.2 mm, a first radius $R_1$ of 3.5 mm and a second radius $R_2$ of 6 mm. In FIG. 11C, the notch has a depth D of 13 mm, a width W of 17.8 mm, a first radius $R_1$ of 2.25 mm and a second radius $R_2$ of 7.5 mm. In FIG. 11D, the notch has a width W of 20 mm, a tip width $W_T$ of 6.75 mm, a first radius $R_1$ of 2.25 mm and a second radius $R_2$ of 7.5 mm. In FIG. 11E, the notch has a width W of 20 mm, a tip width $W_T$ of 7 mm, a first radius $R_1$ of 0.7 mm and a second radius $R_2$ of 7.5 mm. In FIG. 11F, the notch has a width W of 30 mm, a first radius $R_1$ of 4 mm, a second radius $R_2$ of 7.5 mm, and a third radius $R_3$ of 12 mm. In FIG. 11G, the notch has a width W of 38 mm, a first radius $R_1$ of 4 mm, a second radius $R_2$ of 7.5 mm, and a third radius $R_3$ of 12 mm. Although these specific examples have illustrated nose notches having a parabolic shape with radiused terminal ends, it is understood that other shapes could be used. For example, the nose notch could be a triangle, terminating in a sharp point, or a square, rectangle, or trapezoid, having a blunt terminal end.

Figure 12:
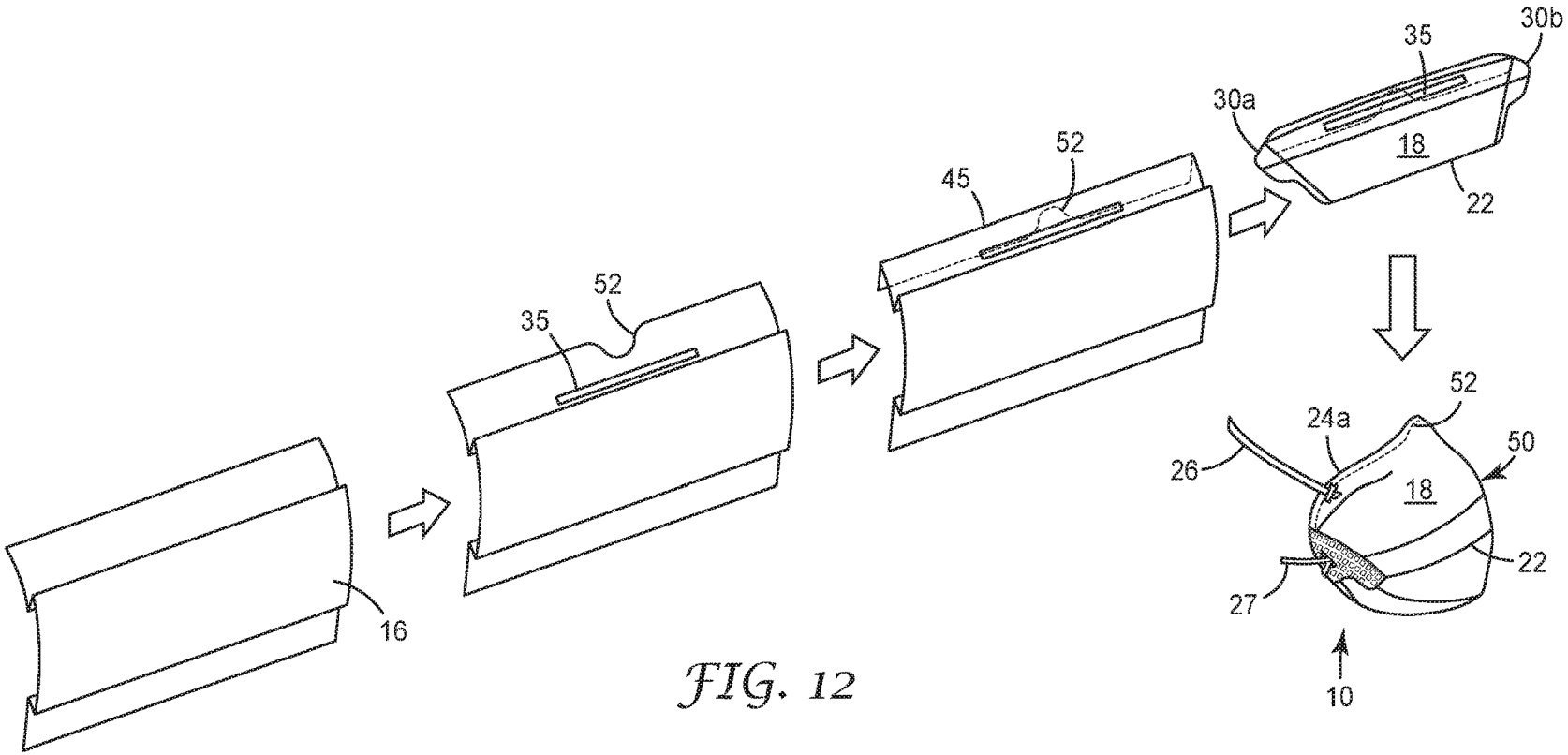
FIG. 12 schematically shows a process for forming a flat-fold filtering face-piece respirator having the mask body 50 and the nose notch 52 of FIGS. 5 and 6.

FIG. 12 illustrates an exemplary method for forming a filtering face-piece respirator 10 having a face mask body 50 with a nose notch 52, such as that illustrated in FIGS. 5, 6 and 7. The respirator 10 is assembled in two operations—mask body making and mask finishing. The mask body making stage includes (a) lamination and fixing of nonwoven fibrous webs (not illustrated in FIG. 12), (b) formation of pleat crease lines, (c) forming of the nose notch, (d) folding the material to form the interior perimeter segments, (e) sealing the lateral mask edges and (f) cutting the final form, which may be done in various sequence(s) or combination(s). The mask finishing operation includes (a) forming a cup-shaped structure, (b) connecting the flanges to the cup-shaped structure and (c) attaching a harness (e.g., straps). At least a portion of this method can be considered a continuous process rather than a batch process; for example, the mask body can be made by a process that is continuous in the machine direction.

Although not shown in FIG. 12, three individual material sheets, an inner cover web 38, an outer cover web 40, and a filtration layer 42, are brought together an plied in face-to-face to form filtering structure 16. These materials are then laminated together, for example, by adhesive, thermal welding, or ultrasonic welding. The resulting material is cut to desired size, typically a length suitable for a single face-piece.

A nose clip 35 is attached and integrally inserted into the sized laminated material, optionally in a pocket formed between outer cover web 40 and filtration layer 42. A nose notch 52 is formed in the edge of filtering structure 16 by removing a portion of the filtering structure. The laminate is then folded and/or pleated and various seals and bonds are made, including fold 45. For this shallow nose notch embodiment, the entire area of the nose notch 52 is located between the edge of the filtering structure 16 and the fold 45; that is, no portion of the nose notch 52 extends to or through the fold 45.

In some embodiments, the material is cut to desired size, typically a length suitable for a single face-piece length after formation of the nose notch 52, fold 45, and/or other folds, pleats and various seals and bonds.

The folded laminate material is then further folded and additional seals are made to form various features, such as flanges 30*a*, 30*b*, on the flat face-piece, and the piece is cut to shape to form a flat mask body.

The flat mask body is expanded to a cup shape, resulting in the filtering face-piece respirator 10 with the nose notch 52 present in the upper interior perimeter segment 24*a* of respirator 10. Straps 26, 27 are added.

Figure 13:
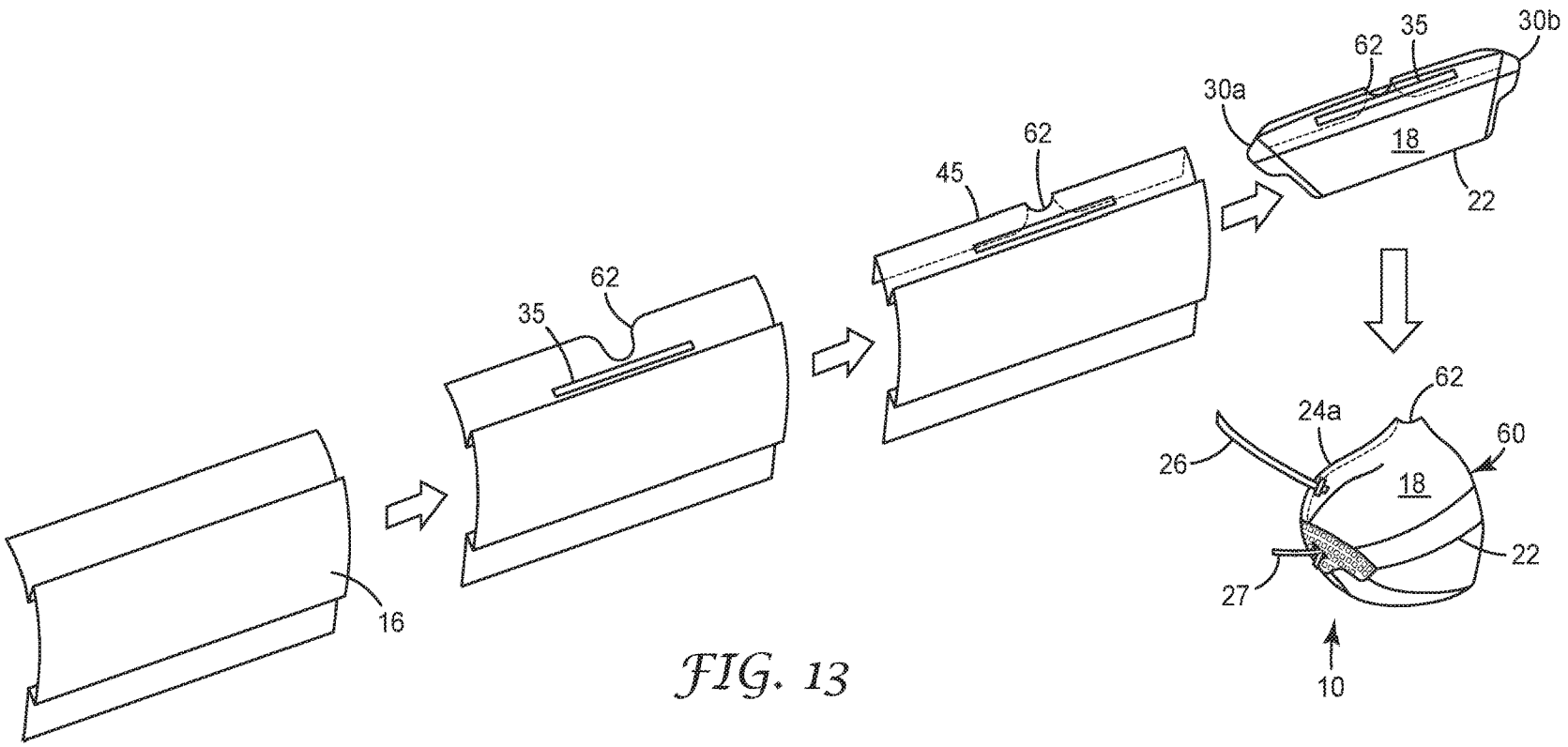
FIG. 13 schematically shows a process for forming a flat-fold filtering face-piece respirator having the mask body 60 and the nose notch 62 of FIGS. 8 and 9.

FIG. 13 illustrates an exemplary method for forming a flat-fold filtering face-piece respirator 10 having a mask body 60 with a nose notch 62, such as that illustrated in FIGS. 8, 9 and 10. Similar to making the face mask body 50 with the nose notch 52 described in respect to FIG. 12, the respirator 10 with the mask body 60 with a nose notch 62 is assembled in two operations—mask body making and mask finishing. However in the process to make the deep nose notch 62, the nose notch 62 is formed in the edge of filtering structure 16 by typically removing a larger (e.g., deeper) portion of the filtering structure 16. The laminate is then folded and/or pleated and various seals and bonds are made, including fold 45. For the deep nose notch embodiment, the nose notch 62 extends from the edge of the filtering structure 16 to the fold 45 and past the fold 45, into the filtering structure 16. The folded laminate material is then further folded and additional seals are made to form various features, such as flanges 30*a*, 30*b*, on the flat mask body. Straps 26, 27 are added and the flat mask body is expanded to a cup shape, resulting in the flat-fold filtering face-piece respirator 10 with the nose notch 62 present in the upper interior perimeter segment 24*a* and the filtering structure 16 of respirator 10.

This invention may take on various modifications and alterations without departing from its spirit and scope.

Accordingly, this invention is not limited to the above-described but is to be controlled by the limitations set forth in the following claims and any equivalents thereof. As an example, the nose notch of this invention may be incorporated into 'flat' face masks, such as those commonly used in the medical profession.

This invention also may be suitably practiced in the absence of any element not specifically disclosed herein.

All patents and patent applications cited above, including those in the Background section, are incorporated by reference into this document in total. To the extent there is a conflict or discrepancy between the disclosure in such incorporated document and the above specification, the above specification will control.

What is claimed is:

1. A method of forming a filtering face-piece respirator, comprising the steps of:

(a) providing an extended length of filtering structure;

(b) removing a notch of filtering structure from an edge of the filtering structure;

(c) folding over the edge of the filtering structure after removing the notch to form an interior perimeter segment;

(d) sealing the single-face-piece length of filtering structure at its ends; and (e) cutting the extended length of filtering structure to a single-face-piece length wherein the step of folding over the edge of the filtering structure after removing the notch comprises folding over the edge of the filtering structure so that the notch extends only in the interior perimeter segment.

2. The method of claim 1, wherein the step of removing the notch of filtering structure is subsequent to the step of cutting the extended length of filtering structure to a single-face-piece length.

3. The method of claim 1, wherein the step of cutting the extended length of filtering structure to a single-face-piece length is subsequent to folding over the edge of the filtering structure.

4. The method of claim 1, wherein the step of folding over the edge of the filtering structure after removing the notch comprises:

folding over the edge of the filtering structure through the notch so that the notch extends through the interior perimeter segment.

* * * * *